US005496440A

United States Patent [19]

Carré et al.

[11] Patent Number: 5,496,440

[45] Date of Patent: Mar. 5, 1996

[54] PROCESS FOR THE MANUFACTURE OF PAPER

[75] Inventors: Bruno Carré, Grenoble, France; Ulf Carlson, Billdal, Sweden

[73] Assignee: Eka Nobel AB, Bohus, Sweden

[21] Appl. No.: 170,282

[22] PCT Filed: Jun. 12, 1992

[86] PCT No.: PCT/SE92/00416

§ 371 Date: Jan. 3, 1994

§ 102(e) Date: Jan. 3, 1994

[87] PCT Pub. No.: WO93/01352

PCT Pub. Date: Jan. 21, 1993

[30] Foreign Application Priority Data

| | | | |
|---|---|---|---|
| Jul. 2, 1991 | [SE] | Sweden | 9102052 |
| Jun. 1, 1992 | [SE] | Sweden | 9201699 |

[51] Int. Cl.[6] ..... D21H 21/10

[52] U.S. Cl. ..... 162/168.3; 162/175; 162/181.1; 162/181.2; 162/181.4; 162/181.5; 162/181.6; 162/181.8; 162/183

[58] Field of Search ..... 162/175, 181.2, 162/181.4, 181.1, 181.5, 183, 168.3, 164.6, 181.6, 181.8

[56] References Cited

U.S. PATENT DOCUMENTS

| | | | |
|---|---|---|---|
| 2,207,555 | 7/1940 | Rowland | 162/175 |
| 2,972,560 | 2/1961 | Stilbert et al. | 162/168.3 |
| 3,151,019 | 9/1964 | Shildneck et al. | 162/175 |
| 3,264,174 | 8/1966 | Aitken et al. | 162/175 |
| 3,706,629 | 12/1972 | Moore et al. | 162/168.3 |
| 4,643,801 | 2/1987 | Johnson | 162/164.1 |
| 4,755,259 | 7/1988 | Larsson | 162/178 |
| 4,798,653 | 1/1989 | Rushmere | 162/168.3 |
| 4,961,825 | 10/1990 | Andersson | 162/175 |
| 5,127,994 | 7/1992 | Johansson | 162/168.3 |
| 5,221,435 | 6/1993 | Smith | 162/175 |
| 5,277,764 | 1/1994 | Johansson | 162/175 |
| 5,368,833 | 11/1994 | Johansson | 423/338 |

FOREIGN PATENT DOCUMENTS

| | | | |
|---|---|---|---|
| 357574 | 3/1990 | European Pat. Off. . | |
| 500770 | 9/1992 | European Pat. Off. . | |
| 1279460 | 11/1960 | France | 162/183 |
| 509002 | 7/1939 | United Kingdom | 162/175 |
| 91/07351 | 10/1990 | WIPO . | |

OTHER PUBLICATIONS

Nelson et at, "Understanding Retention Problems and Retention Aids," *Paper Trade Journal,* Sep. 21, 1964, pp. 39–42.

P. H. Brouwer, "The relationship between zeta potential and ionic demand and how it affects wet–end retention", Retention, Jan. 1991, Tappi Journal, pp. 170–179.

M. J. Gussinyer, "Utilisation du sulfate de chaux comme charge–effets sur la fermeture des circuits", IP 80 33rd Congress de l'Association Technique de L'Industrie Papetiere, Mar. 1980, with English–language abstract.

P. G. Stoutjesdijk et al, "Einsatz von kationischer Stärke bei der Papierherstellung", Wochenblatt for Papierfabrikation 23/24, 1975, pp. 897–901.

*Primary Examiner*—Peter Chin

*Attorney, Agent, or Firm*—Burns, Doane, Swecker & Mathis

[57] ABSTRACT

A process for improved dewatering and retention in the manufacture of paper, where a retention agent containing anionic groups and being based on a polysaccharide or being an acrylamide-based polymer and an alkaline solution of an aluminate are added to the stock containing lignocellulose-containing fibres and optionally fillers. The pH of the stock prior to the addition of the aluminate should be below about 7 to obtain the desired cationic aluminum hydroxide complexes in the stock. The present process is cost effective and insensitive to the content of calcium in the white water.

13 Claims, No Drawings

PROCESS FOR THE MANUFACTURE OF PAPER

The present invention relates to a process for improved dewatering and retention in the paper, where a retention agent containing anionic groups and being based on a polysaccharide or being an acrylamide-based polymer, and an alkaline solution of an aluminate are added to the stock containing lignocellulose-containing fibres and optionally fillers. The pH of the stock prior to the addition of the aluminate should be below about 7 to obtain the desired cationic aluminium hydroxide complexes in the stock. The present invention is cost effective and insensitive to the content of calcium in the white water.

BACKGROUND

In the production of paper, a stock consisting of papermaking fibres, water and normally one or more additives is brought to the headbox of the paper machine. The headbox distributes the stock evenly across the width of the wire, so that a uniform paper web can be formed by dewatering, pressing and drying. The pH of the stock is important for the possibility to produce certain paper qualities and for the choice of additives. A large number of paper mills throughout the world have changed, in the last decade, from acidic stocks to neutral or alkaline conditions. However, this change sometimes requires expensive investments for which reason several mills are still manufacturing paper under acidic conditions.

In the production of paper, improved dewatering and retention are desired. Improved dewatering (drainage) means that the speed of the paper machine can be increased and/or the energy consumption reduced in the following pressing and drying sections. Furthermore, improved retention of fines, fillers, sizing agents and other additives will reduce the amounts added and simplify the recycling of white water.

Fibres and most fillers—the major papermaking components—carry a negative surface charge by nature, i.e. they are anionic. It is previously known to improve the dewatering and retention effect by altering the net value and distribution of these charges. Commonly, starch where cationic groups have been introduced, has been added to the stock because of its strong attraction to the anionic cellulose-containing fibres. This effect has, however, been reduced in mills where the white water is hard, due to the competition for the anionic sites between the cationic starch and calcium ions. For most effective results, it has been thought that there must be a suitable balance between cationic and anionic groups in the starch. Starches, where both cationic and anionic groups are introduced are termed amphoteric and are well known in papermaking.

It is previously known to combine starch with aluminium compounds to further improve the effect. In P. H. Brouwer, Tappi Journal, 74(1), pp. 170–179 (1991) alum is combined with anionic starch to improve the dewatering as well as gloss and strength of packaging paper. In this case the pH of the pulp as well as the white water is 4.4 and the addition of alum 50 kg/ton of pulp.

THE INVENTION

The invention relates to a process for improved dewatering and retention of fines, fillers, sizing agents and other additives in the manufacture of paper, where a retention agent containing anionic groups and an aluminate are added to the stock of lignocellulose-containing fibres.

The invention thus concerns a process for the manufacture of paper on a wire by forming and dewatering a stock of lignocellulose-containing fibres, and optional fillers, whereby a retention agent containing anionic groups, where said retention agent is based on a polysaccharide or is an acrylamide-based polymer, and an alkaline solution of an aluminate are added to the stock, which stock prior to the addition of the aluminate has a pH in the range of from about 3 up to about 7.

According to the present invention it has been found that by adding an alkaline solution containing an aluminate to a stock with a pH below about 7, it is possible to get an interaction between the cationic aluminium hydroxide complexes developed in the stock and the anionic groups of the retention agent and cellulose fibres.

As stated above, conventionally starch where cationic groups have been introduced is used in papermaking. It is advantageous, however, to use starch containing anionic groups since it is much easier and less expensive to introduce anionic groups, such as phosphate groups, than it is to introduce cationic ones, such as tertiary amino or quaternary ammonium groups. According to the present invention it has been found that a retention agent containing anionic groups, which is suitably a starch containing anionic groups, in combination with an alkaline solution containing an aluminate, gives improved and cost effective dewatering and retention in acidic stocks.

The components can be added to the stock in arbitrary order. Preferably the cationic aluminium hydroxide complexes are developed in the presence of lignocellulose-containing fibres. Therefore, the invention especially relates to addition of a retention agent and an aluminate to a stock of lignocellulose-containing fibres, where the addition is separated from the addition of an optional filler. Preferably also, the addition of retention agent to the stock is separated from the addition of aluminate to said stock. A considerable improvement, in comparison with prior art technique, is obtained when the retention agent containing anionic groups is first added and then the aluminate. However, the best effect is obtained if the aluminate is first added to the stock followed by the retention agent containing anionic groups. When an anionic inorganic colloid is added to the stock in addition to the aluminate and in this case a retention agent also containing cationic groups, it is suitable to add said colloid after the addition of aluminate. Preferably the aluminate is added first followed by the retention agent and as the third component the anionic inorganic colloid.

A retention agent used in the present process is based on a polysaccharide, from the groups of starches, cellulose derivatives or guar gums, or is an acrylamide-based polymer. The retention agent containing anionic groups, has negatively charged (anionic) groups, optionally with positively charged (cationic) groups. The cellulose derivatives are e.g. carboxyalkyl celluloses such as carboxymethyl cellulose (CMC). Suitably the retention agent based on a polysaccharide is a starch containing anionic groups.

The acrylamide-based polymers used in the process of the invention are water soluble polymers which contain acrylamide and/or methacrylamide as the main monomeric component. The acrylamide-based polymers contain anionic groups and optionally cationic groups, i.e. the acrylamide-based polymers are either anionic or amphoteric. Preferably the acrylamide-based polymers are anionic. The acrylamide-based polymers suitably have an average molecular weight of from about 10,000 up to about 30,000,000 and preferably from 500,000 up to 20,000,000. The acrylamide-based polymers can be produced by introduction of ionic groups in a polymer containing (meth)acrylamide as the main component. In a polymer containing (meth)acrylamide as the main component anionic groups can be introduced for example by hydrolysis or sulfomethylation reaction, while optional cationic groups can be introduced for example by Hofmann degradation and Mannich reaction. Anionic acrylamide-based polymers can also be prepared by copolymerization of (meth)acrylamide and anionic monomers. Examples of anionic monomers are α,β-unsaturated carboxylic acids and monomers containing sulfonic acid groups or phosphoric acid groups. Amphoteric acrylamide-based polymers can be prepared by copolymerization of (meth)acrylamide and a monomer mixture containing both cationic monomers and anionic monomers. The amphoteric polymers can also be prepared by introduction of cationic groups into a copolymer of (meth)acrylamide and anionic monomers or by introduction of anionic groups into a copolymer of (meth)acrylamide and cationic monomers. The acrylamide-based polymers can have an anionic degree of substitution (DS) of from about 0.5 up to about 100%, suitably from 1.5 up to 90% and preferably from 3 up to 80%.

Although the advantages of the present invention can be obtained with any of the retention agents containing anionic groups and where the retention agent is based on a polysaccharide or is an acrylamide-based polymer, the present invention will be described in the following specification with respect to the use of starch containing anionic groups.

The anionic groups of the starch, which can be native or introduced by chemical treatment, are suitably phosphate, phosphonate, sulphate, sulphonate or carboxylic acid groups. Preferably the groups are phosphate ones due to the relatively low cost to introduce such groups. Furthermore, the high anionic charge density increases the reactivity towards the cationic aluminium hydroxide complexes. The cationic groups are suitably nitrogenous groups, such as tertiary amino or quaternary ammonium groups. The presence of cationic groups is necessary to obtain an increase in dewatering and retention effect when adding an anionic inorganic colloid.

The amount of anionic groups, especially the phosphate ones, in the starch influences the dewatering and retention effect. The overall content of phosphorus in the starch is a poor measure of the anionic groups, since the phosphorus is inherent in the covalently bonded phosphate groups as well as in the lipids. The lipids are a number of fatty substances, where in the case of starch, the phospholipids and especially the lysophospholipids are important. The content of phosphorus, thus, relates to the phosphorus in the phosphate groups covalently bonded to the amylopectin of the starch. Suitably the content of phosphorus lies in the range of from about 0.01 up to about 1% phosphorus on dry substance. The upper limit is not critical but has been chosen for economic reasons. Preferably the content lies in the range of from 0.04 up to 0.4% phosphorus on dry substance.

The starch containing anionic groups can be produced from agricultural products such as potatoes, corn, barley, wheat, tapioca, manioc, sorghum or rice or from refined products such as waxy maize. The anionic groups are native or introduced by chemical treatment. Suitably potato starch is used. Preferably native potato starch is used, since it contains an appreciable amount of covalently bonded phosphate monoester groups (between about 0.06 and about 0.10% phosphorus on dry substance) and the lipid content is very low (about 0.05% on dry substance). Another preferred embodiment of the invention is to use phosphated potato starch.

The aluminate used according to the present invention is per se previously known for use in papermaking. Any aluminate which can be hydrolyzed to cationic aluminium hydroxide complexes in the stock can be used. Suitably the aluminate is sodium aluminate or potassium aluminate. Preferably the aluminate is sodium aluminate.

The effect of the addition of an aluminate is very dependant on the pH of the stock as well as the solution containing the aluminate. According to the invention, the addition of the aluminate at a pH of the stock in the range of from about 3 up to about 7 increases the dewatering speed and degree of retention markedly. Prior to the addition of the aluminate, the pH of the stock lies suitably in the range of from 3.5 up to 7 and more suitably in the range of from 3.5 up to 6.5. Prior to the addition of the aluminate, the pH of the stock lies preferably in the range of from 4.0 up to 6.5 and more preferably in the range of from 4.0 up to 6.0.

Depending on the buffering effect of the stock, the pH of the stock after the addition of aluminate should be in the range from about 3.5 up to about 7. Suitably, after the addition of aluminate the pH of the stock lies in the range of from 4.0 up to 6.5. Preferably, after the addition of aluminium compound the pH of the stock lies in the range of from 4.0 up to 6.0.

When the alkaline solution of aluminate is added to the acidic stock, suitably the pH of the solution is at least about 11 and preferably the pH lies in the range of from 12 up to 14 for the cationic aluminium hydroxide complexes to be developed.

The cationic charge of the various aluminium hydroxide complexes developed decreases with time, an effect which is especially pronounced when the content of calcium in the white water is low. The loss of cationic character especially influences the retention of fines and additives but the dewatering is also influenced. Therefore, it is very important that the aluminate is added shortly before the stock enters the wire to form the paper. Suitably, the aluminate is added to the stock less than about 5 minutes before the stock enters the wire to form the paper. Preferably, the aluminate is added to the stock less than 2 minutes before the stock enters the wire to form the paper.

The added amount of a retention agent based on a polysaccharide, can be in the range of from about 0.05 up to about 10 percent by weight, based on dry fibres and optional fillers. Suitably the amount of a retention agent based on a polysaccharide, lies in the range of from 0.1 up to 5 percent by weight and preferably in the range of from 0.2 up to 3 percent by weight, based on dry fibres and optional fillers.

The added amount of a retention agent being an acrylamide-based polymer, can be in the range of from about 0.005 up to about 2 percent by weight, based on dry fibres and optional fillers. Suitably the amount of an acrylamide-based polymer, lies in the range of from 0.01 up to 1.5 percent by weight and preferably in the range of from 0.02 up to 1.0 percent by weight, based on dry fibres and optional fillers.

The amount of aluminate added can be in the range from about 0.001 up to about 0.5 percent by weight, calculated as $Al_2O_3$ and based on dry fibres and optional fillers. Suitably the amount of aluminate added lies in the range of from 0.001 up to 0.2 percent by weight, calculated as $Al_2O_3$ and based on dry fibres and optional fillers. Preferably the amount of aluminate added lies in the range of from 0.005 up to 0.15 percent by weight, calculated as $Al_2O_3$ and based on dry fibres and optional fillers.

In paper mills where the content of calcium and/or magnesium ions in the white water is high, it is often difficult to produce efficiently paper of good quality. In papermaking, normally the content of magnesium is low, reducing the problem to comprise the presence of calcium ions only. In the case of white water these positive ions can have their origin in the tap water, in additives like gypsum and/or in the pulp, e.g. if a deinked one is used. The calcium ions are adsorbed onto the fibres, fines and fillers, thereby neutralizing the anionic sites. The result is restricted swelling of the fibres giving poor hydrogen bonding and thus paper of low strength. Furthermore, the effect of cationic dewatering and retention agents added is reduced since the possibility of electrostatic interaction has been restricted.

The present invention can be used in papermaking where the calcium content of the white water varies within wide limits. However, the improvement in dewatering and retention of fines and additives compared to prior art techniques increases with the calcium content, i.e. the present process is insensitive to high concentrations of calcium. Therefore, the present invention is suitably used in papermaking where the white water contains at least about 50 mg $Ca^{2+}$/liter. Preferably the white water contains from 100 mg $Ca^{2+}$/liter and the system is still effective at a calcium content of 2000 mg $Ca^{2+}$/liter.

In paper production according to the invention, additives of conventional types can be added to the stock. Examples of such additives are fillers, sizing agents and anionic inorganic colloids. Examples of fillers are China clay, kaolin, talcum, gypsum and titanium dioxide. The fillers are usually added in the form of a water slurry in conventional concentrations used for such fillers. An example of a sizing agent that can be used under acidic conditions is colophony rosin.

In paper production according to the invention, also conventional anionic inorganic colloids can be added to the stock. A prerequisite that such an addition brings about an effect on dewatering and retention is the presence of cationic groups in the retention agent used. The colloids are added to the stock as dispersions, commonly termed sols, which due to the large surface to volume ratio avoids sedimentation by gravity. The terms colloid and colloidal indicate very small particles. The particles of the anionic inorganic substances should suitably have a specific surface area above about 50 $m^2/g$. Examples of such colloids are bentonite, montmorillonite, titanyl sulphate sols, silica sols, aluminium modified silica sols or aluminium silicate sols. Suitably, the anionic inorganic colloids are silica based colloids. Particularly suitable silica based colloids are the aluminium containing silica sols which are disclosed in the European patent 185,068, which is hereby incorporated by reference in this application. Preferably the silica based colloids have at least one surface layer of aluminium silicate or aluminium modified silica, since the aluminium-containing surface layer makes the colloids more resistant under the acidic conditions of the present invention. Also the aluminium modified silica sols disclosed in the PCT application WO 90/00689 are suitable for addition to an acidic stock according to the invention. Here, the aluminium modification of the particles is carried out to a surface modification degree of from 2 up to 25 percent, where the modification degree is the number of aluminium atoms which has replaced silicon atoms in the particle surface.

The colloidal silica particles in the sols should preferably have a specific surface area of from about 50 up to about 1000 $m^2/g$ and more preferably from 100 up to 1000 $m^2/g$. It has been found that the colloidal silica particles should suitably have a particle size below 20 nm and preferably from about 10 down to about 1 nm (a colloidal silica particle having a specific surface area of about 550 $m^2/g$ corresponds to an average particle size of about 5 nm). Silica sols which fulfil the above given specifications are available commercially, e.g. from Eka Nobel AB in Sweden.

Suitable sols can also be based on polysilicic acid, which means that the material of silicic acid exists as very small particles, in the order of 1 nm and with a very large specific area, above 1000 $m^2/g$ and up to about 1700 $m^2/g$ and with some degree of microgel formation. Such sols are described in the Australian patent 598,416.

The amount of anionic inorganic colloid added can be in the range of from about 0.005 up to about 1.0 percent by weight, based on dry fibres and optional fillers. Suitably the amount of the anionic inorganic colloid lies in the range of from 0.005 up to 0.5 percent by weight and preferably in the range of from 0.01 up to 0.2 percent by weight, based on dry fibres and optional fillers.

In paper production according to the invention, also conventional cationic inorganic colloids can be added to the stock. Examples of such positively charged colloids are aluminium oxide sols and surface modified silica based sols. Suitably the colloids are silica based sols. These sols can be prepared from commercial sols of colloidal silica and from silica sols consisting of polymeric silicic acid prepared by acidification of alkali metal silicate. The sols are reacted with a basic salt of a polyvalent metal, suitably aluminium, to give the sol particles a positive surface charge. Such colloids are described in the PCT application WO 89/00062. The suitable amount of cationic inorganic colloid added and order of its addition to the stock corresponds to what is given for the anionic inorganic colloids.

The effect of anionic silica based colloids added is most pronounced where the calcium content of the white water is limited, while the effect of cationic silica based colloids is good even where the calcium content of the white water is high.

The addition of the solution containing aluminate can also be divided into-two batches, to counteract the influence of the so called anionic trash. The trash tend to neutralize added cationic compounds before they reach the surface of the anionic fibres, thereby reducing the intended dewatering and retention effect. Therefore, a part of the solution containing aluminate can be added long before the stock enters the wire to form the paper, to have sufficient time to act as an anionic trash catcher (ATC). The rest of the solution is added shortly before the stock enters the wire, so as to develop and maintain the cationic aluminium hydroxide complexes which can interact with the anionic groups of the retention agent and cellulose fibres. For example, 30% of the amount of aluminium compound in the solution containing the aluminium compound can be used as an ATC and the remaining 70% of the amount of aluminium compound to form the cationic complexes.

Production of paper relates to production of paper, paperboard, board or pulp in the form of sheets or webs, by forming and dewatering a stock of lignocellulose-containing fibres on a wire. Sheets or webs of pulp are intended for subsequent production of paper after slushing of the dried sheets or webs. The sheets or webs of pulp are often free of additives, but dewatering or retention agents can be present during the production. Suitably, the present process is used for the production of paper, paperboard or board.

The present invention can be used in papermaking from different types of lignocellulose-containing fibres. The retention agent and aluminate can for example be used as additives to stocks containing fibres from chemical pulps, digested according to the sulphite, sulphate, soda or organosolv process. Also, the components of the present invention can be used as additives to stocks containing fibres from chemical thermomechanical pulps (CTMP), thermo-mechanical pulps (TMP), refiner mechanical pulps, groundwood pulps or pulps from recycled fibres. The stock can also contain fibres from modifications of these processes and/or combinations of the pulps, and the wood can be softwood as well as hardwood. Suitably the invention is used in papermaking of stocks containing fibres from chemical pulps. Suitably, also, the fibre content of the stock is at least 50 percent by weight, calculated on dry substance.

The invention and its advantages are illustrated in more detail by the following examples which, however, are only intended to illustrate the invention and not to limit the same. The percentages and parts stated in the description, claims and examples, relate to percent by weight and parts by weight, respectively, unless otherwise stated.

EXAMPLE 1

In the following tests the dewatering for stocks has been determined with a "Canadian Standard Freeness (CSF) Tester" according to SCAN-C 21:65, after the addition of the retention agent containing anionic groups and the alkaline solution containing aluminate. Some tests were also carried out after the addition of other or further components, such as an amphoteric potato starch, a polyaluminium chloride, alum and/or an anionic silica based colloid. The stock was agitated at 800 rpm when the components were added and the residence time for each component was throughout 45 seconds for the first one and 30 seconds for the second one. In the tests where three components were used, the residence time for the last component was 15 seconds. The pulp consistency was 0.3% by weight of dry substance. After addition of the two or three components the flocculated stock was passed to the CSF tester and measurements made 35 and 20 seconds, respectively, after the last addition. The collected water is a measure of the dewatering effect and given as ml CSF.

The collected water was very clear after the addition of the components showing that a good retention effect of the fines to the fibre flocks had been obtained by the process according to the invention.

The stock consisted of fibres from a sulphate pulp of 60% softwood and 40% hardwood refined to 200 ml CSF, with 30% of China clay as filler.

The pH of the solution containing sodium aluminate was 13.5, as read from the pH meter.

The polyaluminium chloride (PAC) used was Ekoflock from Eka Nobel AB in Sweden, with a basicity of about 25% and a sulphate and aluminium content of about 1.5 and 10% by weight, respectively, where the content of aluminium was calculated as $Al_2O_3$. The pH of the solution containing PAC was about 1.7, as read from the pH meter.

The starches used were prepared by cooking at 95° C. for 20 minutes. The consistency of the starch solutions prior to the addition to the stock were 0.5% by weight in all experiments.

Table I shows the results from dewatering tests where sodium aluminate was added to the stock followed by various amounts of native potato starch. The amount of aluminate added, was 1.3 kg calculated as $Al_2O_3$ per ton of dry stock including the filler. The additions of aluminate were made at a stock pH of 4.2 and 5.0. For comparison, only native potato starch was added to the stock at a stock pH of 4.2 and 5.0. For further comparison, in two series of experiments polyaluminium chloride (PAC) and alum were added at a stock pH of 4.2, followed by native potato starch. The amount of PAC and alum added, were 1.3 kg calculated as $Al_2O_3$ per ton of dry stock including the filler. The content of calcium was 20 mg/liter. Prior to the addition of the additives, the dewatering effect of the stock with filler was 295 ml CSF. The results in ml CSF are given in Table I.

TABLE I

| | | Starch, kg/ton of dry stock | | |
|---|---|---|---|---|
| Additives | pH | 5 | 10 | 15 |
| NPS (comp.) | 4.2–5.0 | 255 | 255 | 250 ml CSF |
| AlNa + NPS | 4.2 | 355 | 435 | 455 ml CSF |
| AlNa + NPS | 5.0 | 325 | 365 | 370 ml CSF |
| PAC + NPS (comp.) | 4.2 | 265 | 265 | 260 ml CSF |
| Alum + NPS (comp.) | 4.2 | 275 | 310 | 310 ml CSF |

wherein NPS = native potato starch
AlNa = sodium aluminate
PAC = polyaluminium chloride
Alum = aluminium sulphate As can be seen from Table I, the addition of sodium aluminate in combination with native potato starch at a pH within the pH range of the invention enhances the dewatering. The dewatering effect with aluminate is improved when the added amount of starch is increased, especially at a low pH. Furthermore, the use of aluminate and native potato starch is much more efficient than combinations of PAC or alum with native potato starch. Also, at a pH of 4.2 the addition of alum and native potato starch means a reduced or essentially unaltered dewatering effect as compared to the dewatering effect of the stock itself.

EXAMPLE 2

Table II shows the results from dewatering tests with the same stock as in Example 1, where sodium aluminate was added to the stock followed by native potato starch. The amount of sodium aluminate added, was 1.3 kg calculated as $Al_2O_3$ per ton of dry stock including the filler. The amount of starch added, was 15 kg per ton of dry stock including the filler. The additions of aluminate were made at a stock pH of 4.2. The calcium content was 20 and 640 mg/liter of white water. For comparison, only native potato starch was added to the stock at a stock pH of 4.2. The results in ml CSF are given below.

TABLE II

| | Calcium content, mg/liter of white water | |
|---|---|---|
| Additives | 20 | 640 |
| Only stock | 295 | 315 ml CSF |
| NPS (comp.) | 250 | 280 ml CSF |
| AlNa + NPS | 455 | 485 ml CSF |

wherein NPS = native potato starch
AlNa = sodium aluminate

As can be seen from Table II, the addition of sodium aluminate in combination with native potato starch at a pH within the pH range of the invention enhances the dewatering at a calcium content of 20 as well as 640 mg/liter. The dewatering is more efficient at 640 mg $Ca^{2+}$/liter, which is a very hard water.

EXAMPLE 3

Table III shows the results from dewatering tests, where sodium aluminate was added to a stock followed by native potato starch. The stock was the same as the one used in Example 1, except that 30% calcium carbonate was used as filler. The amount of sodium aluminate added, was 1.3 kg calculated as $Al_2O_3$ per ton of dry stock including the filler. The amount of starch added, was 15 kg per ton of dry stock including the filler. The additions of aluminate were made at a stock pH of 6.5. The calcium content was 20 and 640 mg/liter of white water. For comparison, only native potato starch was added to the stock at a stock pH of 6.5. The results in ml CSF are given below.

TABLE III

| Additives | Calcium content, mg/liter of white water 20 | 640 |
|---|---|---|
| Only stock | 320 | 325 ml CSF |
| NPS (comp.) | 275 | 280 ml CSF |
| AlNa + NPS | 390 | 415 ml CSF |

wherein NPS = native potato starch
AlNa = sodium aluminate

As can be seen from Table III, the addition of sodium aluminate in combination with native potato starch at a pH of 6.5 enhances the dewatering at a calcium content of 20 as well as 640 mg/liter.

EXAMPLE 4

Table IV shows the results from dewatering tests where sodium aluminate, amphoteric potato starch and an anionic silica based colloid were added to a stock consisting of bleached fibres from a sulphate pulp of 50% softwood and 50% hardwood refined to 360 ml CSF with 30% China clay as filler. The anionic silica based colloid was an aluminium modified silica sol sold by Eka Nobel under the tradename BMA-9, with a specific surface area of 550 $m^2/g$ and a mean particle size of 5 nm. The amount of starch and silica based colloid added, were 15 kg/ton of dry stock and 2 kg/ton of dry stock, respectively. The amount of aluminate added was 1.3 kg calculated as $Al_2O_3$ per ton of dry stock including filler. The amount of cationic and anionic, native groups in the amphoteric starch were about 0.35% N and 0.08% P, respectively. The additions of aluminate were made at a stock pH of 4.1. The calcium content was 20, 160 and 640 mg/liter of white water. For comparison, polyaluminium chloride, amphoteric potato starch and the anionic silica based colloid were added to the stock. The addition of PAC was made at a stock pH of 4.1. The results in ml CSF are given below.

TABLE IV

| Additives | Calcium content, mg/liter of white water 20 | 160 | 640 |
|---|---|---|---|
| Only stock | 450 | 475 | 480 ml CSF |
| AlNa + APS | 620 | 600 | 590 ml CSF |
| APS + AlNa | 515 | 535 | 535 ml CSF |
| AlNa + APS + BMA | 645 | 630 | 610 ml CSF |
| BMA + APS + AlNa | 555 | 550 | 540 ml CSF |
| PAC + APS + BMA (comp.) | 520 | 525 | — ml CSF |

wherein AlNa = sodium aluminate
APS = amphoteric potato starch
BMA = anionic silica based colloid
PAC = polyaluminium chloride As can be seen from Table IV, the addition of sodium aluminate and amphoteric potato starch increases the dewatering effect considerably, especially if the aluminate is added first. When the anionic silica based colloid is added the effect is further increased, especially if the colloid is added as the last component. Also, the use of aluminate with amphoteric potato starch and silica based colloid is much more efficient than combinations of PAC with amphoteric potato starch and silica based colloid. The dewatering effect is only slightly reduced as the calcium content is increased.

EXAMPLE 5

Table V shows the results of retention tests, where sodium aluminate, amphoteric potato starch and an anionic silica based colloid were added to the same stock as used in Example 4. The retention of filler was determined with a retention sheet former, developed to determine the total and filler retention within the paper industry at the Centre Technique de l'Industrie des Papiers, Cartons et Celluloses (CTP) in Grenoble, France. The contact time between the stock and the first, second and third additive added, were the same as for the dewatering experiments. The stock was agitated at 1200 rpm when the additives were added, to simulate shear forces occurring in a paper machine. The amount of starch added was 8 and 12 kg/ton of dry stock. The anionic silica based colloid was the same as the one used in Example 4. The amount of silica based colloid added, was 2 kg/ton of dry stock. The amount of aluminate added was 0.4 kg calculated as $Al_2O_3$ per ton of dry stock including filler. The amount of cationic and anionic, native groups in the amphoteric starch were about 0.35% N and 0.08% P, respectively. The additions of aluminate were made at a stock pH of between 4 and 4.5. After the additions the stock pH was 5.5. The calcium content was 80 mg/liter of white water. For comparison, only amphoteric starch was added to the stock at a stock pH of between 4 and 4.5. The retention of filler with only the stock was 17%. The results of the filler retention tests in % are given below.

TABLE V

| Additives | Starch, kg/ton dry stock 8 | 12 |
|---|---|---|
| APS (comp.) | 64% | 62% |
| AlNa + APS | 77% | 79% |
| AlNa + APS + BMA | 85% | 90% |

wherein AlNa = sodium aluminate
APS = amphoteric potato starch
BMA = anionic silica based colloid As can be seen from Table V, the addition of sodium aluminate before the addition of amphoteric potato starch increases the degree of retention considerably. When the anionic colloid is added the effect is further increased.

EXAMPLE 6

Table VI shows the results of retention tests, where sodium aluminate and anionic polyacrylamides were added to the same stock as used in Example 4. The retention of filler was determined with a retention sheet former developed at CTP in Grenoble, France. The contact time between the stock and the first and second additive were the same as for the dewatering experiments. The stock was agitated at 1200 rpm when the additives were added. The four polyacrylamides used had the following characteristics:

| Designation | Molecular weight | Anionic degree of substitution (DS), % |
|---|---|---|
| APAM1 | 15,000,000 | 10 |
| APAM2 | 7,000,000 | 10 |
| APAM3 | 15,000,000 | 34 |
| APAM4 | 7,000,000 | 34 |

The amount of polyacrylamide added was 1.2 kg/ton of dry stock. The amount of aluminate added was 1.3 kg calculated as $Al_2O_3$ per ton of dry stock including filler. The pH of the stock prior and after the addition of aluminate were about 4 and 5.5, respectively. The calcium content was 80 mg/liter of white water. For comparison, experiments were carried out in which only the anionic polyacrylamides were added to the stock at a stock pH of about 5.5. For further comparison, polyaluminium chloride and one of the anionic polyacrylamides were added to the stock. The pH of the stock before and after the addition of PAC, were about 6 and 5.5, respectively. The filler retention with the stock only was 21%. The results of the filler retention tests in % are given below.

TABLE VI

| Additives | Retention of filler % |
|---|---|
| — + APAM1 (comp.) | 65 |
| AlNa + APAM1 | 83 |
| — + APAM2 (comp.) | 57 |
| AlNa + APAM2 | 70 |
| — + APAM3 (comp.) | 54 |
| AlNa + APAM3 | 77 |
| — + APAM4 (comp.) | 56 |
| AlNa + APAM4 | 78 |
| PAC + APAM4 (comp.) | 47 |

wherein AlNa = sodium aluminate
APAM = anionic polyacrylamide
PAC = polyaluminium chloride As can be seen from Table VI, the addition of aluminate and polyacrylamide according to the invention, increases the retention of filler. Also, the use of aluminate with polyacrylamides is much more efficient than combinations of PAC with polyacrylamides.

EXAMPLE 7

Table VII shows the results from dewatering tests where sodium aluminate and anionic polyacrylamides were added to the stock used in Example 4, except that it was refined to 200 ml CSF prior to the addition of China clay. The three polyacrylamides were used also in Example 6 and designated in the same way. The amount of sodium aluminate added was 1.3 kg calculated as $Al_2O_3$ per ton of dry stock including filler. The pH of the stock prior and after the addition of aluminate were about 4 and 5.5, respectively. The calcium content was 80 mg/liter of white water. The dewatering effect of the stock before addition of the additives was 275 ml CSF. Comparative tests in which the anionic polyacrylamides were added without aluminate, showed that the dewatering effect decreased or remained essentially unaltered. The results in ml CSF are given below.

TABLE VII

| Additives | Polyacrylamide, kg/ton of dry stock 0.4 | 0.8 | 1.2 |
|---|---|---|---|
| AlNa + APAM1 | 335 | 495 | 655 ml CSF |
| AlNa + APAM2 | 320 | 395 | 435 ml CSF |
| AlNa + APAM3 | 300 | 365 | 610 ml CSF |

wherein AlNa = sodium aluminate
APAM = anionic polyacrylamide

As can be seen from Table VII, the addition of aluminate and polyacrylamide according to the invention, increases the dewatering effect considerably.

EXAMPLE 8

Table VIII shows the results from dewatering tests where sodium aluminate and amphoteric polyacrylamides were added to the stock used in Example 7. The amount of sodium aluminate added was 1.3 kg calculated as $Al_2O_3$ per ton of dry stock including filler. The molecular weight of the two amphoteric polyacrylamides, designated AMPAM1 and AMPAM2, were 14,000,000 and 19,000,000, respectively. For both polyacrylamides, the anionic and cationic degree of substitution were 10% and 35%, respectively. The pH of the stock prior and after the addition of aluminate were 4.5 and 5.5, respectively. The calcium content was 80 mg/liter of white water. The dewatering effect of the stock before addition of the components according to the invention, was 295 ml CSF.

TABLE VIII

| Additives | Polyacrylamide, kg/ton of dry stock 0.4 | 0.8 | 1.2 | 1.6 |
|---|---|---|---|---|
| AMPAM1 (comp.) | 300 | 330 | 360 | — ml CSF |
| AlNa + AMPAM1 | 360 | 450 | 495 | 565 ml CSF |
| AMPAM2 (comp.) | 305 | 325 | 345 | 350 ml CSF |
| AlNa + AMPAM2 | 375 | 465 | 500 | 525 ml CSF |

wherein AlNa = sodium aluminate
AMPAM = amphoteric polyacrylamide

As can be seen from Table VIII, the addition of aluminate and amphoteric polyacrylamide according to the invention increases the dewatering effect.

We claim:

1. A process for the production of paper on a wire by forming and dewatering a stock of lignocellulose-containing fibers, comprising the steps of sequentially adding to said stock of lignocelluosic fibers having a pH within the range of from 3.0 to 7.0:

(a) an alkaline solution of an aluminate, said aluminate being added in an amount of at least 0.001% by weight, calculated as $Al_2O_3$ and based on dry fibers;

(b) a retention agent containing anionic and cationic groups, said retention agent being based on a polysaccharide or being an acrylamide-based polymer, the retention agent based on a polysaccharide is added in an amount of at least 0.05% by weight, based on dry fibers, and the retention agent being an acrylamide-based polymer is added in an amount of at least 0.005% by weight, based on dry fibers; and (c) an anionic inorganic colloid selected from the group consisting of bentonite, montmorillonite, titanyl sulphate sols, silica sols, aluminum modified silica sols, and aluminum silicate sols, said anionic inorganic colloid being added in an amount of at least 0.005% by weight, based on dry fibers;

wherein the pH of the stock after the addition of aluminate is in the range of from 3.5 to 7.

2. A process according to claim 1, including the step of adding fillers to the stock.

3. A process according to claim 1, wherein the anionic inorganic colloid is a silica based colloid containing particles having a particle size below 20 nm.

4. A process according to claim 1, wherein the amount of anionic inorganic colloid added lies in the range of from 0.005 to about 1.0% by weight, based on dry lignocellulosic fibers.

5. A process according to claim 2, wherein the amount of inorganic colloid added lies in the range of from 0.005 to 1.0% by weight, based on dry lignocellulosic fibers and fillers.

6. A process according to claim 1, wherein the stock has a pH between 3 and 6.0 before the addition of aluminate and a pH in the range of from 3.5 to 6.0 after the addition of aluminate.

7. A process according to claim 1, wherein the retention agent is based on a polysaccharide.

8. A process according to claim 1, wherein the retention agent is starch.

9. A process according to claim 7, wherein the retention agent is potato starch.

10. A process according to claim 1, wherein the retention agent is an acrylamide-based polymer.

11. A process according to claim 1, wherein the content of calcium ions in the white water obtained by dewatering the stock on the wire is at least about 50 mg $Ca^{2+}$/liter.

12. A process according to claim 3, wherein the silica based colloid contains colloidal particles having a specific surface area of from 50 to 1000 $m^2/g$.

13. A process according to claim 3, wherein the silica based colloid is based on polysilicic acid having a specific surface area of from 1000 to 1700 $m^2/g$.

* * * * *